United States Patent [19]

Pingel et al.

[11] Patent Number: 4,856,452

[45] Date of Patent: Aug. 15, 1989

[54] EXTENDIBLE STERN LIGHT ASSEMBLY

[76] Inventors: Robert L. Pingel, P.O. Box 45, Oakland, Ark. 72611; Matthias A. Pingel, 9837 Tesson Ferry Rd., St. Louis, Mo. 63123

[21] Appl. No.: 145,555

[22] Filed: Jan. 19, 1988

[51] Int. Cl.[4] ..... B63B 45/06

[52] U.S. Cl. ..... 114/364; 114/343; 362/61; 362/413

[58] Field of Search ..... 114/343, 364; 403/104, 403/109; 248/161; 362/61, 83, 413, 418, 424, 431, 449, 450, 382

[56] References Cited

U.S. PATENT DOCUMENTS

| | | | |
|---|---|---|---|
| 1,994,886 | 3/1935 | Doane | 362/413 |
| 2,819,547 | 1/1958 | Clements, Jr. | 403/109 |
| 3,369,117 | 2/1968 | Nicolosi | 362/413 |
| 3,517,184 | 6/1970 | Norton et al. | 403/104 |

FOREIGN PATENT DOCUMENTS

| | | | |
|---|---|---|---|
| 548923 | 11/1957 | Canada | 362/61 |
| 740476 | 11/1932 | France . | |
| 267419 | 3/1927 | United Kingdom | 362/61 |

*Primary Examiner*—Joseph F. Peters, Jr.
*Assistant Examiner*—Edwin L. Swinehart
*Attorney, Agent, or Firm*—Haverstock, Garrett & Roberts

[57] ABSTRACT

A stern light assembly adapted for mounting on boats and the like including an extendible support structure, the support structure including a plurality of tubular members telescopically positioned one within another, each of the tubular members being telescopically slidably engaged with at least one other member whereby the members can be moved between a first condition wherein the support structure is in an elongated extended condition and a second collapsed condition thereof, a lamp unit having electrical connections associated therewith mounted at one end of one of the tubular members, a power fitting having electrical connections associated therewith mounted adjacent to the opposite end of another of the tubular members, and a resilient normally contracted coiled electrical cord contained within the tubular members, the coiled cord having connections at one end thereof for connecting to the electrical connections of the lamp unit and at the opposite end thereof for connecting to the electrical connections of the power fitting, the coiled cord having an unstressed length that is approximately equal to the length of the support structure in its collapsed condition. The present assembly is adapted to replace existing stern lights on boats and includes various arrangements for both limiting the extendibility of one tubular member relative to another and for holding and maintaining the respective tubular members relative to each other at locations intermediate the first and second conditions thereof.

15 Claims, 3 Drawing Sheets

Fig. 4
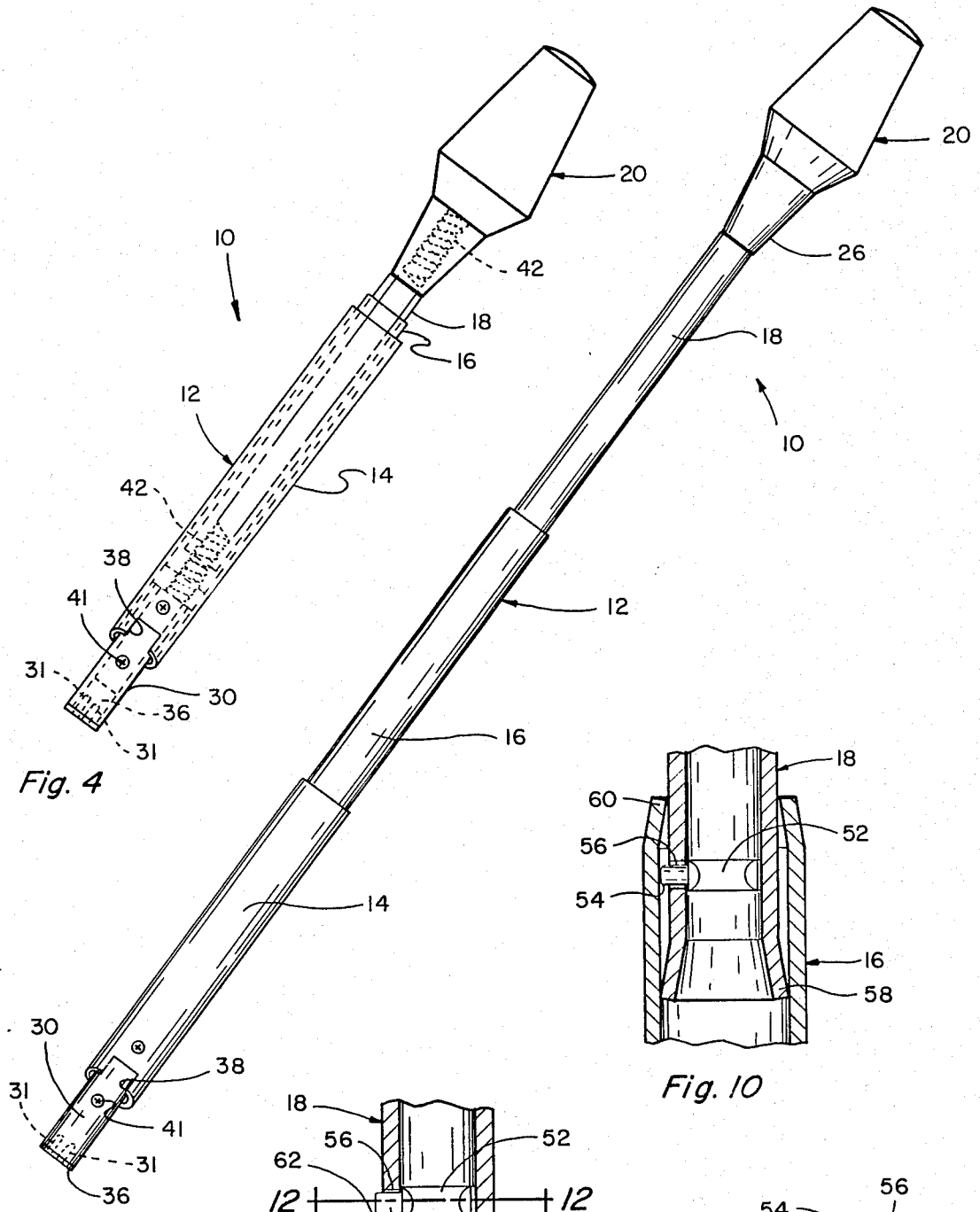
Fig. 5
Fig. 10
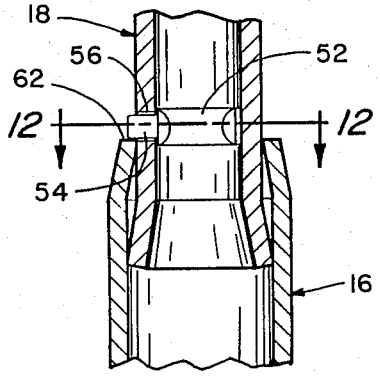
Fig. 11
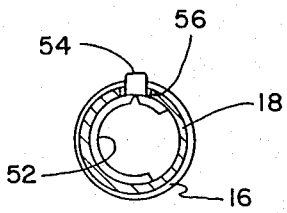
Fig. 12

EXTENDIBLE STERN LIGHT ASSEMBLY

BACKGROUND OF THE INVENTION

The present invention pertains generally to an extendible stern light assembly for boats and, more particularly, to an extendible stern light assembly that is mounted on a collapsible support structure and is adapted to replace conventional stern light assemblies.

DESCRIPTION OF THE PRIOR ART

The increasing popularity or boating has created a substantial need for improved safety feature and warning light systems for boats. This is especially important to fishermen and others who are out on lakes and rivers during the twilight and nighttime hours, and especially for fishermen who often fish from boats which are substantially stationary in the water.

Conventional stern light assemblies include relatively long non-collapsible support structures such as long poles or rods which are mounted to a boat at an appropriate location. The length of such poles or rods are usually required or established for safety reasons by appropriate laws and regulations affecting watercraft and the safe operation thereof and are sufficiently long so that they can be easily seen, especially at a distance. One of the main problems associated with attaching stern lights to the upper end portion of relatively long support assemblies is that the longer support assemblies often interfere with use of the boat for fishing and the like and especially for casting, trolling and reeling in fish. This is particular worrisome for fishermen who must "park" their boats in the water and attempt to manipulate their fishing rods and lines over and around the long stern light assemblies mounted at the rear of the boat. In addition, such long non-collapsible support assemblies suffer the disadvantage that, due to their length, such stern light support assemblies must be dismounted, removed and stored prior to transporting the boat to which such assembly was attached on a trailer or other transportation vehicle. Removal of the stern light assemblies is an inconvenience to a boatman, and storing the assemblies may facilitate damage to or loss of the lights or assemblies during transportation. Also, although visibility is improved by mounting the stern lights on relatively long support assemblies, such assemblies are subject to damage by whiplash due to movement of the boat over and through rough water since such movement produces additional forces and stresses on the entire stern light assembly as the boat transgresses from one wave to another.

Although use of shorter stern light support assemblies alleviate some of the aforementioned problems, such assemblies then present a problem in that they do not always conform to the prescribed length as required by appropriate laws and/or regulations. Also, mounting stern lights directly on boats or attaching them to relatively short support structures results in visibility and safety problems as well in that such assemblies are not easy to see, especially at a distance, and when there are waves, and then the boats on which they are mounted are moving at relatively high speeds. These conditions are compounded at night when it is important for boaters to be able to see other boats at as great a distance as possible to avoid collisions.

On attempt to solve both the safety and transportation problems commonly associated with prior art stern light assemblies is to mount the stern lights on rigid supports adapted to be slidably movable between an extended upright condition and a retracted condition wherein the respective support assembly is received through an opening in the hull of a boat and can be stored therewithin. This is usually done on relatively large boats or cruisers where sufficient space is available in the hull of the boat to accommodate such an arrangement. However, while this type of stern light assembly may solve the lure casting and transportation problems, it is inadequate as to safety aspects since the length of the support assembly is limited by the depth of the boat's hull and such an arrangement does not always yield a stern light assembly of proper height or length. Also, such an arrangement is not feasible on smaller size boats. Retracting the support assembly into the boat is also likely to scar or otherwise damage the boat hull, especially hulls made of fiberglass, since the bottom end portion of the support assembly often rubs against the hull when it is fully retracted. The electrical cord connected to the stern light can also be cut or otherwise damaged when the support assembly is fully retracted and the cord is caught between the support structure and the boat's hull.

SUMMARY OF THE INVENTION

The present stern light assembly solves the safety, casting and transportation problems and other disadvantages associated with known stern light assemblies by providing an extendible body or support structure having a stern light mounted on one end thereof, which support structure includes mounting means at the other end thereof adapted to fit existing stern light mountings on boats. The extendible support structure can be constructed so as to be extendible to any desired length, so the stern light can be elevated to a height required by existing laws and regulations where it is easily visible to other boaters even under adverse conditions such as storms, high waves, or when the boats are travelling at high speeds. The extendible support structure preferably includes a plurality of tubular members that are telescopically positioned one within another, and includes stop or limiting means in the form of various types of friction lock means which limit the outward extension of one tubular member relative to the adjacent members and which act to hold and retain one tubular member relative to another at any desired extended condition. In addition, the present assembly overcomes many of the problems and disadvantages of known assemblies because the tubular members can be collapsed or telescoped together to provide a relatively compact arrangement which would preferably be only between about six to twelve inches high, and which can then be pushed down into the hull of the boat when collapsed if the mounting structure on the boat so allows to further facilitate boat use and transportation. The present assembly can also be only partially collapsed as desired to facilitate casting or trolling and yet still provide the improved safety aspects of an easily visible stern light.

It is therefore a principal object of the present invention to provide an extendible stern light assembly which promotes improved safety conditions for boaters.

Another object is to provide an extendible stern light assembly including an extendible support structure which facilitates elevating the stern light to a sufficient height so that the light is easily visible to other boaters from a relatively great distance, even when the boat is operating in relatively wavy conditions and/or is moving at relatively fast speeds.

Another object is to provide an extendible assembly which can be collapsed when not in use to facilitate boating activities including casting and trolling, and to facilitate transporting the boat on a trailer or like device.

Another object is to provide an extendible assembly that includes a coiled, extensible resilient electric cord which facilitates extending and collapsing the support assembly without crimping or otherwise damaging the cord.

Another object is to provide an extendible stern light assembly adapted to be mounted in existing mounting means used for mounting stern light assemblies on boats and the like.

Another object is to provide an extendible light assembly which can be collapsed to facilitate storage of the boat such as in a garage or boat shed without requiring removal of the assembly from the boat.

Another object is to provide an extendible stern light assembly which includes means for limiting the extendibility of one tubular member relative to another adjacent tubular member.

Another object is to provide an extendible stern light assembly which includes means for holding and maintaining one tubular member at an intermediate location relative to the opposite end portions of an adjacent tubular member.

These and other objects and advantages of the present invention will become apparent to those skilled in the art after considering the following detailed specification which discloses several different embodiments of the present adjustable stern light assembly in conjunction with the accompanying drawings, wherein:

DESCRIPTION OF THE DRAWINGS

FIG. 4 is a side elevational view of the present stern light assembly shown in its fully collapsed condition with a resilient coiled electrical cord therein, the cord being shown in dotted outline form in its fully retracted condition;

FIG. 5 is a side elevational view of the present stern light assembly shown in its fully extended condition;

FIGS. 10 and 11 are cross-sectional fragmentary views showing still another form of movement limiting means; and FIG. 12 is a cross-sectional view taken along line 12—12 of FIG. 11.

DESCRIPTION OF THE PREFERRED EMBODIMENT

Figure 1:
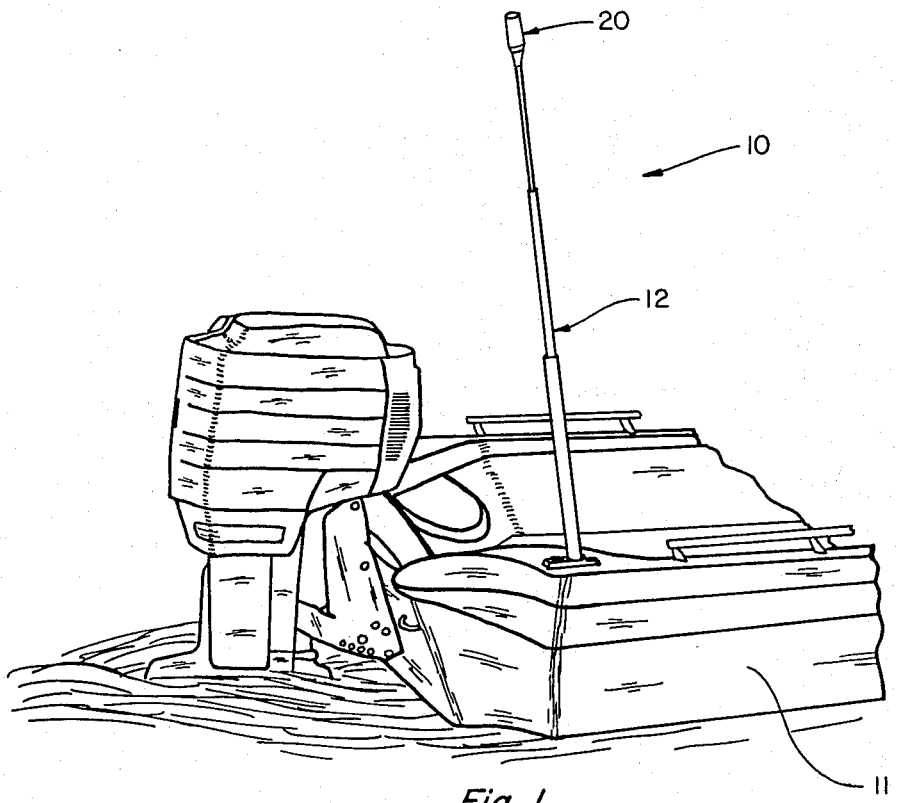
FIG. 1 is a perspective view of a preferred embodiment of the present stern light assembly shown mounted on the stern portion of a boat.
Figure 2:
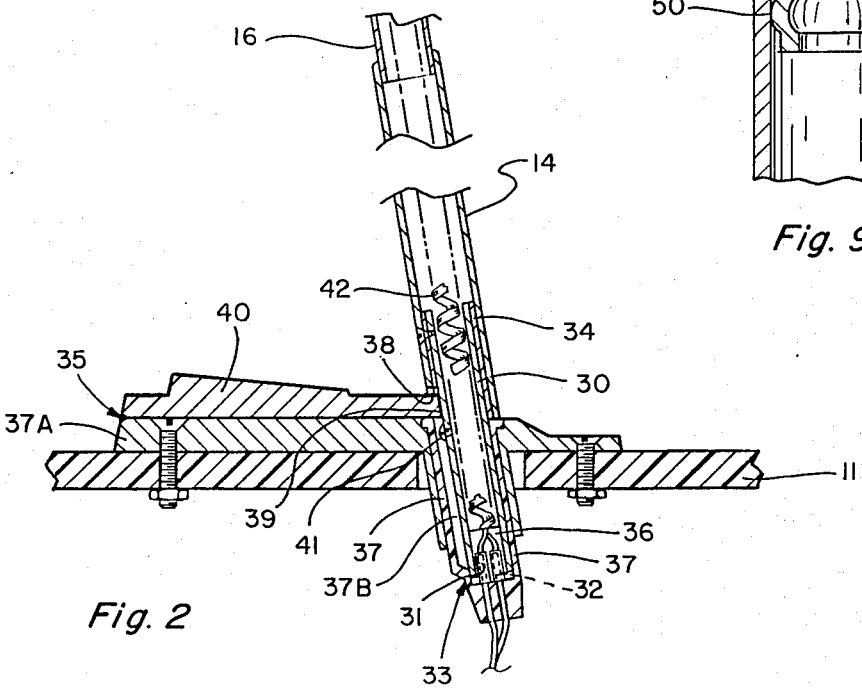
FIG. 2 is a cross-sectional side elevational view of the stern light assembly of FIG. 1 showing means for mounting the assembly on a boat.

Referring to the drawings are particularly by reference numbers wherein like numerals refer to like parts, number 10 in FIGS. 1, 2, 4 and 5 refers to a preferred embodiment of the present extendible stern light assembly, the assembly 10 being shown in FIG. 1 mounted and raised to its fully extended condition on the stern of boat 11. The assembly 10 includes an extendible support structure 12 which is shown in FIG. 2 as including tubular members 14, 16 and 18. A lamp unit 20 is mounted on the upper portion end of the upper member 18. It is preferable to construct the member 14, 16 and 18 of a rustproof material such as aluminum or like materials for maintenance purposes. The members 14, 16 and 18 are also shown as hollow members telescopically positioned one within another to provide for inexpensive manufacture and to facilitate operation thereof, and also to facilitate connecting the lamp unit 20 to an electrical source as will be hereinafter more fully explained. The assembly 10 is shown in its fully extended condition in FIGS. 2 and 5 wherein respective telescoping members 14, 16 and 18 have been pulled or otherwise drawn out to their fullest extent, which extension may be limited by means which will be further discussed with respect to FIGS. 7–12.

Figure 3:
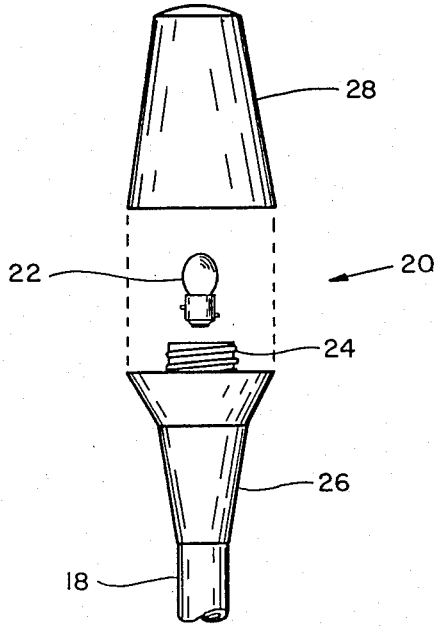
FIG. 3 is a fragmentary exploded side elevational view of the upper end portion of the present stern light assembly showing the lamp unit.

The lamp unit 20 (FIG. 3) can be of common design, including a light bulb 22 which can be mounted in an electrical socket 24 that is fixedly attached to or integrally formed with a base member 26. The base 26 can be mounted or fixedly attached to the upper end portion of member 18. An outer protective housing 28 can be removably mounted on the base 26 such as by threadedly attaching the housing 28 thereto. Typically, the housing 28 will be constructed of plastic or like material that is of suitable color such as white, red or green, which colors are well known in the boating industry, white generally representing the stern, and red and green representing the port and starboard sides of a boat, respectively. However, it is recognized that other types and colors of housings and light bulbs may also be used.

At the opposite end of the extendible support structure 12 from the lamp unit 20 is a mounting connection or tubular power fitting member 30 (FIG. 2) which is shown as being fixedly attached to the lower end of the member 14 and which includes female electrical connection means such as the contact openings 31. The contact openings 31 are adaptable for receiving the pin or bayonet type electrical connection members 32 associated with the male portion of the electrical fixture 33 shown in FIG. 2. The male fixture 33 is associated with conventional stern light mounting means such as the mounting 35 shown in FIG. 2. Many different types of electrical connection means are available and within the scope of this invention. In this regard, it is important that the present stern light assembly can be made to replace conventional stern light assemblies and can be mounted in existing mounting structures associated with a wide plurality of boats, such as in existing male fixture 33 shown in FIG. 2.

The tubular power fitting or extension member 30 is slidably receivable into and fixedly attached by any suitable means to the lower end portion of member 14 as best shown in FIGS. 2, 4 and 5. An additional tubular member such as the member 34 may be positioned between the members 14 and 30 to help secure the member 30 to the lower end portion of member 14. The member 34 extends only partway within the member 14 adjacent the lower end portion thereof as shown in FIG. 2 and adds additional strength and stability to the joinder of members 14 and 30 and the overall assembly 10, particularly, when the member 30 is engaged with the mounting fixture 33 associated with a particular boat. An electrical plug type member 36 (FIGS. 2, 4 and 5) is insertably engaged with the lower end portion of the tubular extension member 30 and houses the female electrical contact openings 31.

The mounting fixture 33 includes a tubular shaped member 37 which extends downwardly from the plate member 37A associated with the conventional mounting 35 into the hull of the boat, the member 37 including the male electrical pin connection members 32 shown in FIG. 2 and being adaptable to receive the power fitting member 30 therewithin such that the pin or bayonet members 32 are insertably engaged with the contact openings 31. An elastic O-ring or like device (not shown) may be positioned about the upper portion of the member 30 between the annular lip formed at the lower end of the member 14 and that formed at the upper end of the member 37 to act as a seal when the assembly 10 is engaged with the mounting fixture 33 to prevent water from seeping into and short circuiting the electrical connections between the electrical pin members 32 and the contact openings 31.

The tubular member 14 as well as the member 34 includes a notch or cut-out portion 38 (FIGS. 2, 4 and 5) formed in a portion of the respective surfaces thereof, the notch 38 being positioned and located to register with and receive one end portion of the cover member which is usually associated with existing mounting structures such as the end portion 39 of the cover 40 associated with the conventional mounting means 35 shown in FIG. 2. The cover member 40 is pivotally mounted to the member 37A and, when the assembly 10 is mounted in the fixture 33, the cover 40 can be rotated so that the end portion 39 thereof is received within the notch 38 as shown in FIG. 2. When the plate 40 is so positioned, the projection member 41 associated with the member 30 engages the lip or flange associated with the underside portion of the end portion 39 and prevents the assembly from being removed therefrom. In this regard, the tubular member 37 may include a cavity or bowed area 37B which extends outwardly from a portion of the member 37 along one side thereof as shown in FIG. 2, the area or cavity 37B being adaptable to receive the projection 41 to allow free movement thereof within the member 37 as the power fitting 30 is moved into and out of engagement with the fixture 33. The projection 41 may include the head of a screw or any other projection means attached to or formed integral with the member 30. When the end portion 39 of the cover 40 is pivotally moved out of engagement with the notch 38, the assembly 10 is free to be slidably removed from the fixture 33. In this regard, the cover member 40 is pivotally rotatable through at least 180° so that the opposite end portion thereof can be positioned over the tubular member 37 to protect the same as well as the electrical connection members 32 contained therein from damage and/or water when the assembly 10 is removed therefrom.

An important feature of the present invention is a coiled extensible cord 42 (FIG. 2) which is preferably loosely contained within the hollow members 14, 16 and 18, which cord is shown as being connected at opposite ends thereof between the contact openings 31 and the lamp socket 34 to conduct electricity therebetween. The length of the coiled cord 42 should be selected to enable the members 14, 16 and 18 to be telescopically extended or collapsed without crimping or otherwise damaging the cord 42, and such that the normally closed coil length of the cord 42 is about the same length as the members 14, 16 and 18 together in their collapsed condition.

The preferred embodiment of the present stern light assembly 10 is further shown in FIGS. 4 and 5 in its collapsed and extended conditions, respectively, and is shown having only three respectively, and is shown having only three extendible tubular members 14, 16 and 18, although additional members could be used. The lower member 14 is shown having the largest inner and outer diameters and the outside diameter of the member 16 is shown as being about the same diameter or slightly smaller than the inside diameter of the member 14 such that the member 16 may be slidably received in the member 14. Likewise, the outside diameter of member 18 should be about the same diameter or slightly smaller than the inside diameter of the member 16 to make for slidable contact therewith. Some slight tapering of the members 14, 16 and 18 may even be desirable, the important thing being that such members will frictionally slide one within the other and will maintain any extended position desired, especially the fully extended position.

The members 14, 16 and 18 are shown in FIG. 4 in their collapsed conditions, with the member 18 being retracted into and substantially entirely contained within the member 16, and with the member 16 being retracted into and substantially entirely contained within the member 14. The retracted condition demonstrates the importance of having the cord 42 be of a coiled construction so that when the members 14, 16 and 18 are in their collapsed conditions as shown in FIG. 4, the coils of cord 42 are likewise contracted without crimping or otherwise rubbing on the members and thereby being damaged.

The stern light assembly 10 may be placed in its extended condition as shown in FIG. 5 such as by grasping the lamp unit 20 and pulling upwardly thereon. This "pulling" action slidably moves the member 18 outwardly relative to the member 16 and at the same time the member 16 is drawn out relative to the member 14 up to its fully extended position.

Figure 6:
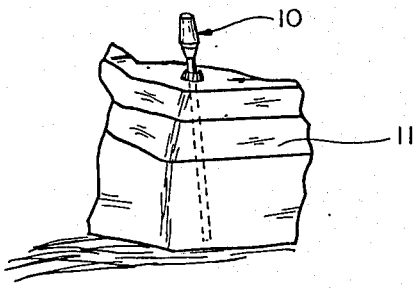
FIG. 6 is a perspective view of the present stern light assembly showing the support structure in dotted outline form retracted into the hull of a relatively large boat when the assembly is in its fully collapsed condition.

It is also anticipated that the support structure 12 may be adapted to be placed in its collapsed condition totally within the hull of a boat to facilitate transporting or storing the boat, and to facilitate casting, trolling and bringing in fish when the boat is in use. This is usually only feasible on relatively large boats or cruisers where sufficient space is available in the hull of the boat to accept the support structure 12 in its collapsed condition. The support structure 12 of the present assembly 10 is shown in FIG. 6 in such a recessed or withdrawn condition in the hull of boat 11.

Although it will generally be preferred to fully collapse or extend support structure 12 as described above, it may be desirable in some situations to only partially collapse or extend one or more of the tubular members 16 and 18. A person fishing from a boat that is stationary and away from the general boating traffic may want more flexibility in casting and trolling without abandoning the safety aspects associated with the present stern light assembly, and may in such circumstances partially collapse only one or more of the respective tubular members to provide a more compact stern light assembly which is still easily visible to approaching boaters. This may also be accomplished when the boat is moving through rough water since any potential for whiplash damage to the assembly 10 is reduced when the support structure 12 is in a partially collapsed condition. Such a position still affords good visibility to oncoming boaters.

Figure 7:
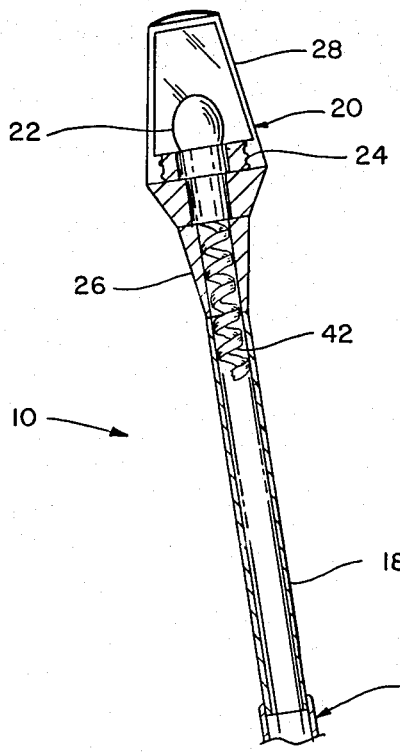
FIG. 7 is a cross-sectional fragmentary view showing one form of means for limiting movement of one tubular member relative to another, said means being shown in exaggerated form for illustrative purposes only.
Figure 7:
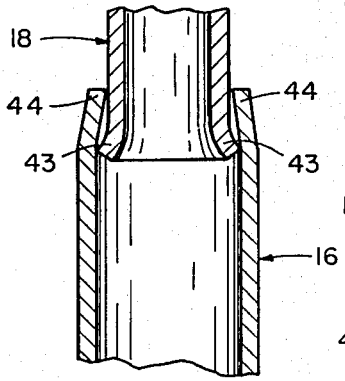

The means for maintaining one tubular member in its extended position relative to another tubular member include limiting means, one example being shown in FIG. 7 as relating to members 16 and 18. The limiting means shown are greatly exaggerated for ease of understanding and may include an outwardly flared portion 43 at the lower end of member 18, and an inwardly curved or flared portion 44 at the upper end of member 16. Flaring or swaging the ends of members 16 and 18 in this manner can be easily accomplished by known means during the manufacturing process such that the outer diameter of the outwardly flared portion 43 is the lower end of member 18, and an inwardly curved or flared portion 44 at the upper end of member 16. Flaring or swaging the ends of members 16 and 18 in this manner can be easily accomplished by known means during the manufacturing process such that the outer diameter of the outwardly flared portion 43 is substantially the same as the inner diameter of the tubular member 16, and such that the diameter of the inwardly flared portion 44 is substantially the same as the other diameter of member 18. Rounding the edges on the flared portions to prevent scarring of the adjacent member is possible, which scarring is aesthetically and structurally undesirable. When member 18 is extended relative to member 16, the flared portions 43 and 44 act not only to limit the extension of member 18 but also serve to lock or maintain member 18 in an extended position relative to member 16 because of the frictional contact and the relatively tight cooperative engagement between the portions 43 and 44 and the respective members 16 and 18. These same limiting means may similarly be applied to the respective mated portions of members 14 and 16, and to the mated portions of any additional tubular members associated with the support structure 12.

Figure 8:
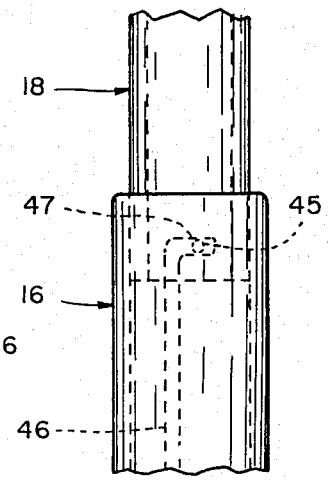
FIGS. 8 and 9 are cross-sectional fragmentary views showing other forms of movement limiting means.

Other extension limiting means are shown in FIG. 8 in relation to the members 16 and 18. In this embodiment, one or more guide members or lugs 45 may be integrally formed with or fixedly attached to the outside surface of any one or more of the members 14, 16 and 18, preferably adjacent the lower ends thereof. In FIG. 8, a single lug member 45 is shown mounted near the lower end of the member 18. An even more effective limiting means may include having lug members 45 mounted opposite one another on the outside surface of the member 18. The lug members 45 are shown as being slidably movable in one or more L-shaped grooves 46 which are formed or machined into the inner surfaces of members 14 and 16 and/or the mounting structure 37. In FIG. 8, a single L-shaped groove 46 is shown formed in the inner surface of member 16. One of the lug members 45 is constrained to move in the groove 46, thereby providing extension limiting means. The groove 46 has a right angle groove portion 47 into which the lug 45 can be moved by twisting or rotating the member 18 relative to the member 16, thereby holding the member 18 in its extended condition. Pulling outwardly on the member 18 causes lug members 45 to move longitudinally within the respective associated grooves 46 of tubular member 16. Thereafter the member 18 being pulled outwardly is rotated such that the lug members 45 associated therewith move circumferentially into the groove portions 47 which creates the locked condition. Forming a plurality of groove portions 47 at longitudinally spaced locations along and intersecting with the grooves 46 provides a plurality of locking positions to maintain the lamp unit 20 extended at different heights above the boat as desired. Similarly extension limiting means may also be provided in the mated connections of members 14 and 16, and the mounting structure 37 and member 14.

Figure 9:
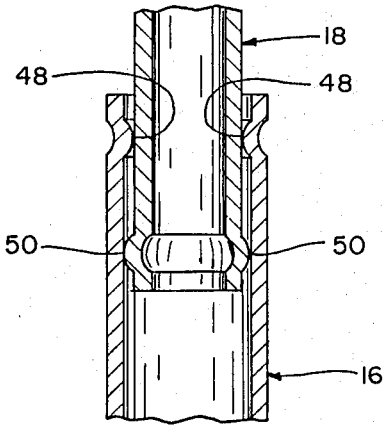

Still another example of extension limiting means for use with the present stern light assembly 10 are shown in FIG. 9 in relation to the members 16 and 18. In this example, the members 16 and 18 each include an annular projection positioned adjacent one end portion thereof, the projection 48 being located on the inner surface of the member 16 adjacent the upper end portion thereof and the projection 50 being located on the outer surface of the member 18 adjacent the lower end portion thereof. The annular projection 48 on the member 16 extends inwardly therefrom towards the member 18 and makes for a tight fitting slidable engagement with the outer surface of the member 18 while the annular projection 50 on the member 18 extends outwardly therefrom towards the member 16 and makes for a tight fitting slidable engagement with the inner surface of the member 16. The annular projections 48 and 50 provide a friction lock between the members 16 and 18 and serve to lock or maintain the member 18 in an extended position relative to member 16 because of the frictional contact and the relatively tight cooperative engagement between the projections 48 and 50 and the respective members 16 and 18. Also, the member 18 may be extended upwardly relative to the member 16 to a position where the annular projection 50 engages the annular projection 48 thereby providing stop or limiting means for positively locking and maintaining the member 18 in a fully extended position relative to the member 16 and preventing the member 18 from becoming disengaged from the member 16. The member 14 may have similar projection means thereon to cooperate with projection means at the lower end of the member 16 and so on. It is also anticipated that the tubular members may include projection means at a plurality of spaced locations therealong to provide a plurality of similar mating arrangements for the adjacent members, the size of such intermediate projection means being such so as to enable a user to override, by a pulling force, the frictional contact between the projection means located intermediate the respective end portions of each tubular member so that each member may be extended upwardly to its fully extended position.

A still further form of movement limiting means for use with the present stern light assembly 10 is illustrated in FIGS. 10–12 in relation to the members 16 and 18. In this embodiment, a C-shaped clamp 52 having a button head projection 54 extending outwardly adjacent one end portion thereof is insertably positioned within the tubular member 18 as shown in FIGS. 10–12. The C-shaped clamp member 52 may be fixedly secured to the inner surface of the member 18 by any suitable means such as by welding, soldering or other similar means, or the member 52 may be securely held in position due to the tight fitting frictional fit between the member 52 and the inner surface of the member 18. The projection 54 extends outwardly towards the member 16 through an opening 56 formed in the member 18 and engages the inner surface of the member 16 as best shown in FIG. 10. The projection 54 makes for a tight fitting slidable engagement with the inner surface of the member 16 as the member 18 is moved therewithin and this provides a friction lock between the members 16 and 18 which serves to hold and maintain the member 18 at any intermediate position between a fully collapsed position and a fully extended position as previously explained. This is so because the clamp member 52 is made of a resilient type material such as a spring steel material and is specifically dimensioned relative to the inner diameter of the tube member into which it is inserted such that the clamp member 52 must be squeezed or compressed inwardly in order to be inserted therewithin such as into the member 18. The spring tension or elasticity associated with the clamp member 52, when squeezed into the particular tubular member such as the member 18, makes for an extremely tight compression fit between the member 52 and the inner surface of the member 18 and the elasticity of the member 52 forces the projection 54 through the opening 56 and into relatively tight cooperative frictional engagement with the inner surface of the member 16. This provides sufficient frictional contact to securely lock and maintain the member 18 in an intermediate position relative to the opposite end portions of the member 16. This same arrangement may be similarly applied to the respective mated portions of members 14 and 16 as well as to the mated portions of any additional tubular members associated with the extendible support structure 12.

Use of the C-shaped clamp member 52 is advantageous to the present invention because it enables the passageway through each of the tubular members 14, 16 and 18 to remain open and unobstructed so that the coiled extensible cord 52 may easily pass and extend through and within each of the members 14, 16 and 18. The clamp member 52 also enables the coiled cord 42 to both freely extend and collapse without crimping or otherwise damaging the same due to binding or other interference with the clamp member 52. This is important to the present invention because any damage to the coiled cord 42 will render the stern light inoperative. It is also recognized that a wide variety of other clamping means may be utilized in the present invention so long as the coiled cord 42 is allowed to sufficiently move within the respective tubular members between its fully collapsed condition and its fully extended condition without damage thereto. In addition, it is also recognized that the lower end portion of the member 18 may include an outwardly flared portion such as the flared portion 58 and the upper end portion of the member 16 may include an inwardly flared portion such as the flared portion 60. The flared portions 58 and 60 are substantially similar in construction to the construction of the flared portions 43 and 44 associated with the embodiment shown in FIG. 7 and function to both limit the extension of the member 18 relative to the member 16 and also serve as an additional locking means to maintain the member 18 in an extended position as previously explained.

It is also possible to position the C-shaped clamp 52 within the tubular member 18 at a distance spaced from the lower end thereof such that when the member 18 is moved to its fully extended position relative to the member 16, the projection 54 is moved to a position outside the member 16 such that the projection 54 extends across and engages the annular edge portion 62 associated with the upper end of the member 16 as best shown in FIGS. 11 and 12. This arrangement serves as an additional stop or limiting means for positively locking and maintaining the member 18 in a fully extended position relative to the member 16 and prevents the member 18 from being collapsed into the member 16 without first depressing the projection 54 inwardly to clear the edge portion 62. This is important to the present invention because this arrangement prevents the extendible support structure 12 from freely collapsing due to vibration and/or other forces exerted on the support structure 12 due to movement of the boat across the water. Depressing the projection 54 to a position such that it clears the inner wall surface of the member 16 allows the extended member 18 to be collapsed into the member 16 to any desired position.

It is also possible to produce extension limiting or locking means by simply tapering the tube members 14, 16 and 18. This is a well known technique used in other type constructions and such a construction produces frictional connections to retain the members in their extended condition.

It is recognized that various acceptable materials of construction are available and could equally be employed to fabricate the various components of the present stern light assembly 10. For example, such components could be casted from aluminum, or other durable and rustproof materials such as certain other metal alloys which are able to withstand moderate impact and mishandling and also supply the necessary strength and rigidity. It is also recognized that certain relatively strong plastic materials as well as other types of materials may likewise be utilized in fabricating many, if not all, of the components of the present assembly so long as such materials are able to withstand the desired forces exerted thereagainst during normal boat operations.

Thus there has been shown and described a novel extendible stern light assembly for boats which fulfills all of the objects and advantages sought therefor. Many changes, modifications, variations, and other uses and applications of the present invention, will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A stern light assembly adapted for engagement with stern light mounting fixtures associated with boats and like vehicles, said assembly comprising an extendible support structure, said support structure including a plurality of tubular members telescopically positioned one within another, each of said tubular members being telescopically slidably engaged with at least one other member whereby said members can be moved between a first condition wherein said support structure is in an elongated extended condition and a second collapsed condition thereof, a lamp unit mounted at one end of one of said tubular members, said lamp unit having electric connections thereto, a tubular power fitting member slidably receivable within the opposite end of another of said tubular members, said tubular power fitting member being cooperatively removably engageable with the stern light mounting fixture associated with a particular boat and having electrical connections thereto, and a resilient normally contracted coiled electrical cord contained within said tubular members and having connections at one end to the electrical connections of said lamp unit and at the opposite end to the electrical connections of said power fitting member, said coiled cord having an unstressed length that is approximately equal to the length of said support structure in the collapsed condition thereof.

2. The assembly of claim 1 including means which limit the extendibility of one of said tubular members relative to another adjacent one of said members.

3. The assembly of claim 2 wherein said limiting means include an inwardly flared upper end associated within one of said tubular members and on outwardly flared lower end associated with the other of said tubular members, said one tubular member being telescopically slidably engageable with said other tubular member, the inwardly and outwardly flared ends cooperating to limit extension of said one tubular member relative to said other tubular member.

4. The assembly of claim 2 wherein said limiting means include at least one lug member positioned adjacent to one end of and on the outside surface of said one tubular member and at least one L-shaped groove formed on the inside surface of said other tubular member, said L-shaped groove having a longitudinal groove portion and at least one circumferentially extending groove portion, said longitudinal groove portion positioned to slidably receive said lug member therein to facilitate movement of said one tubular member between said first and second conditions thereof, and said circumferentially extending groove portion positioned to receive said lug member therein when said one tubular member is rotated relative to said other tubular member to lock and maintain said one tubular member in its extended condition.

5. The assembly of claim 2 wherein said limiting means include at least one annular projection located on the outside surface of one of said tubular members adjacent one end portion thereof, an annular projection located on the inside surface of another one of said tubular members adjacent an end thereof which is adjacent to the annular projection associated with said one tubular member when said one tubular member is in its extended position, said one tubular member being slidably movable within said other tubular member between its first and second conditions whereby the projection on said one tubular member engages the projection on said other tubular member to positively lock and maintain said one tubular member in its extended condition.

6. The assembly of claim 2 wherein said limiting means includes a resilient member insertably receivable within one of said tubular members adjacent one end portion thereof, said resilient member including a projection member extending outwardly therefrom, an opening through said one tubular member adapted to receive said projection member, said one tubular member being slidably movable within another adjacent tubular member between its first and second conditions, said resilient member exerting a sufficient force against said projection member whereby said projection member extends through said opening in said one tubular member and frictionally engages the inside surface of said adjacent tubular member to positively hold and maintain said one tubular member at an intermediate position between its first and second conditions.

7. The assembly of claim 6 wherein said resilient member includes a C-shaped member.

8. The assembly of claim 6 wherein said projection member extends across an edge portion of one end of said adjacent tubular member when said one tubular member is in its fully extended condition.

9. The assembly of claim 2 wherein said limiting means include one tapered tubular member that is slidably engaged within another tapered tubular member, said one member being telescopically slidably movable within said other member between its first and second conditions such that said members frictionally engage each other to maintain said one member in its extended condition.

10. A stern light assembly adaptable for being positioned within a stern light mounting fixture on a boat, said mounting fixture including electrical connections for connecting to the stern light assembly positioned therewithin, said stern light assembly comprising a collapsible support structure, said collapsible support structure including a plurality of elongated tubular members telescopically fitted one within another, said support structure adapted to be moved between a first collapsed condition wherein all of said tubular members are telescoped one within the other and a second extended condition wherein each member extends from said adjacent members, a lamp unit mounted to one end of one of said tubular members, said lamp unit having electrical connections thereto, means at the opposite end of another of said tubular members for mounting said assembly within the stern light mounting fixture associated with said boat, said mounting means including a tubular power fitting member having electrical connections thereto, and means for connecting the electrical connections of said lamp unit to the electrical connections of said power fitting member, said power fitting member being cooperatively engageable with said mounting fixture such that the electrical connections of said power fitting member make electrical contact with the electrical connections of said mounting fixture.

11. The assembly of claim 10 wherein said connecting means include a normally contracted resilient coiled electrical cord contained within said elongated tubular members, said cord being connected at one end thereof to the electrical connections of said lamp unit and at the other end thereof to the electrical connections of said power fitting member, said cord having an unstressed length that is substantially the same as the length of said support structure in its collapsed condition.

12. THe assembly of claim 10 including limiting means associated with said tubular members, said limiting means adapted to lock the adjacent tubular members in their extended positions when said support structure is in its second extended condition.

13. The assembly of claim 10 including means to hold and maintain the adjacent tubular members at an intermediate location between said first and second conditions.

14. The assembly of claim 10 wherein the electrical connections associated with said power fitting member include female electrical connection means and the electrical connections associated with said mounting fixture include male electrical connection means, said male connection means being insertably engaged with said female connection means when said power fitting member is engaged with said mounting fixture.

15. A stern light assembly for boats comprising an extendible support structure, said support structure including a plurality of tubular members telescopically engaged one within another, said tubular members each being adapted to be telescopically slidably movable between a first extended condition wherein at least one of said tubular members is extended from the adjacent tubular members and a second collapsed condition thereof wherein said tubular members extend within one another, a lamp unit mounted to one tubular member at one end thereof, said lamp unit having electrical connections thereto, a power fitting member at an opposite end of another of said tubular members having electrical connections thereto, a coiled extension electrical cord contained within said tubular members, said cord being connected at one end thereof to the electrical connections of said lamp unit and at the opposite end thereof to the electrical connections of said power fitting member, said cord having an unstressed length that is approximately equal to the length of said support structure in its fully collapsed condition, mounting means on a boat for cooperatively engaging said power fitting member, said boat mounting means having electrical connections thereto, the electrical connections of said power fitting member engaging the electrical connections of said boat mounting means when said power fitting member is engaged therewith.

* * * * *